United States Patent [19]

Benham

[11] 4,452,355

[45] Jun. 5, 1984

[54] DISPLAY CARTON

[75] Inventor: Albert A. Benham, Granville, Mass.

[73] Assignee: Champion International Corporation, Stamford, Conn.

[21] Appl. No.: 418,633

[22] Filed: Sep. 16, 1982

[51] Int. Cl.[3] ..... B65D 25/00

[52] U.S. Cl. ..... 206/45.31; 206/45.14; 206/315.9; 229/39 B

[58] Field of Search ..... 206/45.14, 45.31, 420, 206/418, 419, 315.9; 229/39 B

[56] References Cited

U.S. PATENT DOCUMENTS

| | | | |
|---|---|---|---|
| 3,019,958 | 2/1962 | Asman et al. | 206/45.31 |
| 3,185,662 | 5/1965 | De Feo | 206/45.31 |
| 3,282,410 | 11/1966 | Cote | 206/45.31 |
| 3,447,672 | 6/1969 | Bailey et al. | 206/45.31 |
| 3,482,678 | 12/1969 | Mason | 206/45.14 |
| 3,493,103 | 2/1970 | Cote | 206/45.14 |
| 3,618,848 | 11/1971 | Pawlowski | 206/45.14 |
| 3,765,529 | 10/1973 | Mueller | 206/557 |
| 3,887,067 | 6/1975 | Collura et al. | 206/45.14 |
| 3,896,928 | 7/1975 | Forté206 | 45.14/ |
| 3,987,893 | 10/1976 | Hanson | 206/45.31 |
| 4,162,008 | 7/1979 | McCalmont | 206/45.14 |
| 4,200,192 | 4/1980 | Klomp | 206/418 |

FOREIGN PATENT DOCUMENTS

| | | | |
|---|---|---|---|
| 1126527 | 9/1968 | United Kingdom | 206/45.31 |

*Primary Examiner*—William T. Dixson, Jr.
*Assistant Examiner*—David Fidei
*Attorney, Agent, or Firm*—Evelyn M. Sommer; William W. Jones

[57] ABSTRACT

A display carton for holding a spherical object, such as a basketball or the like wherein the object is displayed to a potential purchaser. The carton has framing flaps which engage the object being displayed to retain it in place in the carton. The framing flaps are locked in place so that the object cannot be easily removed from the carton.

6 Claims, 8 Drawing Figures

DISPLAY CARTON

This invention relates to an improved display carton formed from paperboard, which carton is adapted to contain a spherical object, such as a basketball, soccer ball, or the like, while allowing substantial portions of the object to be displayed to a potential purchaser.

It is known to provide display cartons in which spherical objects, such as basketballs, soccer balls or the like are contained and are displayed for potential purchasers. Such cartons are desirable because the purchaser can see, touch and pick up the object while in the carton. Such cartons are disclosed in prior U.S. Pat. Nos. 3,987,893; and Des. 246,440, both to W. E. Hanson. Since these cartons are specifically designed to expose a substantial portion of the object being displayed, there exists the possibility that the object can be intentionally or unintentionally removed from the display carton. It is apparent that, with such a possibility existing, a purchaser could remove a more expensive article from its carton and put it in the carton holding a less expensive article of the same type. When such a switch is made, the purchaser can then purchase the more expensive article at the lower price set forth on the less expensive article's carton.

The display carton of this invention substantially reduces the possibility of switching articles between cartons by locking the framing panels of the carton in place in an article-retaining position so that the article cannot be easily removed from the carton without noticeably damaging the carton. The framing panels are provided with mating locking flaps and recesses or pockets which are difficult to detect and which securely hold the framing panels in their article-engaging positions.

It is, therefore, an object of this invention to provide an improved article display carton wherein the displayed article is a spherical object.

It is a further object of this invention to provide a carton of the character described wherein framing panels are provided on the carton for framing the article being displayed and holding the latter in place within the carton.

It is another object of this invention to provide a carton of the character described wherein the framing panels are locked in their article retaining position to prevent removal of the article from the carton without substantially damaging the carton.

These and other objects and advantages of the invention will be more readily apparent from the following detailed description of preferred embodiments of the invention when taken in conjunction with the accompanying drawings, in which.

Figure 1:
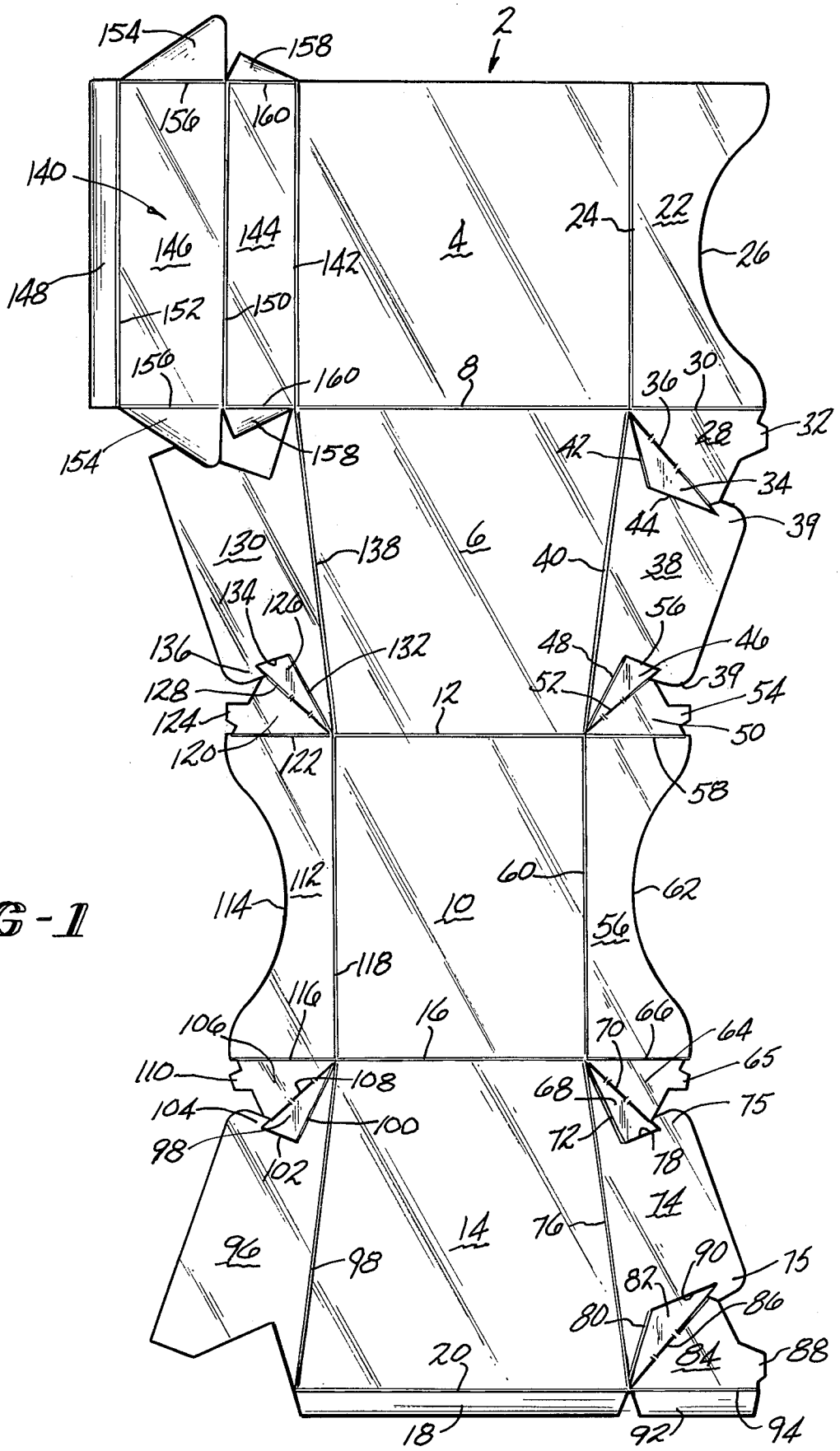
FIG. 1 is a plan view of one embodiment of a precut and scored paperboard blank from which the carton of this invention can be erected.
Figure 2:
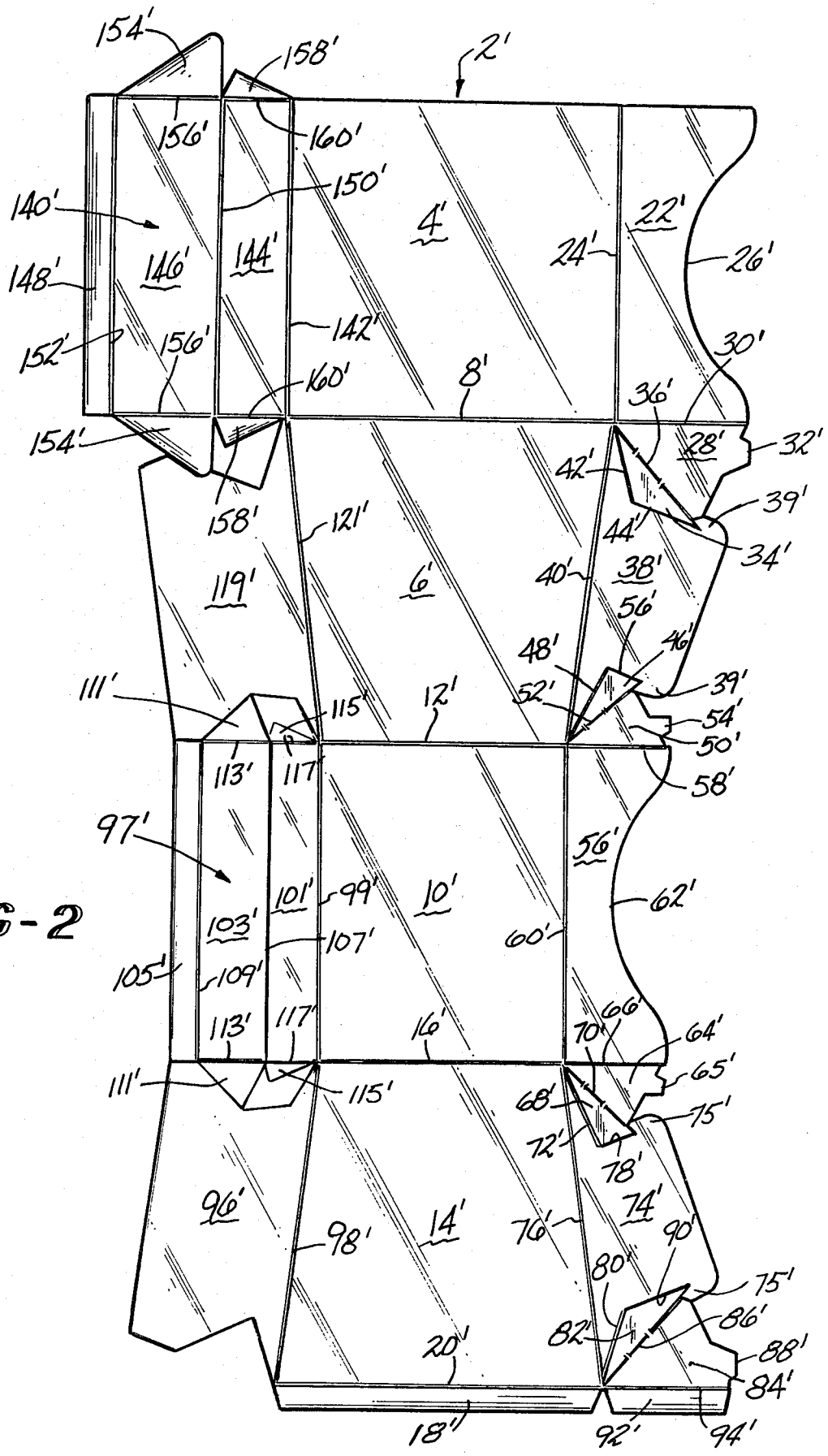
FIG. 2 is a plan view of another embodiment of a precut and scored paperboard blank from which the carton of this invention can be erected.

Referring now to FIGS. 1 and 2 two precut, scored one-piece paperboard blanks are shown, which blanks are adapted to form two embodiments of cartons formed in accordance with this invention. Like numerals shall be used to identify like components of the blanks, which shall be denoted generally by the numerals 2 and 2'. Each blank 2 and 2' includes a bottom wall panel 4 and 4' having a first side wall panel 6 and 6' connected thereto along a fold line 8 and 8'. A top wall panel 10 and 10' is foldably connected to the first side wall panel 6 and 6' along a fold line 12 and 12'. A second side wall panel 14 and 14' is foldably connected to the top wall panel 10 and 10' along a fold line 16 and 16', and a glue flap 18 and 18' is foldably connected to the second side wall panel 14 and 14' by a fold line 20 and 20'. An article framing and retention panel 22 and 22' is foldably connected to the back edge of the bottom panel 4 and 4' along a fold line 24 and 24'. The framing and retention panel 22 and 22' has a curvilinear free edge 26 and 26' for engaging the spherical article to be contained in the carton. A generally triangular tucking and locking panel 28 and 28' is connected to a side edge of the framing and retention panel 22 and 22' by a fold line 30 and 30'. A locking projection 32 and 32' is formed on the free edge of the tucking and locking panel 28 and 28'. A triangular connecting panel 34 and 34' is connected to the tucking and locking panel 28 and 28' along a fold line 36 and 36'. A locking panel 38 and 38' is connected to the back edge of the first side wall panel 6 and 6' along a fold line 40 and 40' and is also connected to the tucking and locking panel 34 and 34' along a fold line 42 and 42'. The side edge 44 and 44' of the locking panel 38 and 38' is free of connection with the triangular connecting panel 34 and 34'. A second triangular connecting panel 46 and 46' is connected to the locking panel 38 and 38' along a fold line 48 and 48' and is also connected to a second tucking and locking panel 50 and 50' along a fold line 52 and 52'. The tucking and locking panel 50 and 50' has a locking projection 54 and 54' formed on its free edge. The edge 56 and 56' of the locking panel 38 and 38' is free of connection with the triangular connecting panel 46 and 46'. The tucking and locking panel 50 and 50' is connected to a second article framing and retention panel 56 and 56' along a fold line 58 and 58' and the second article framing and retention panel 56 and 56' is also connected to the back edge of the top wall panel 10 and 10' along a fold line 60 and 60'. The second article and retention panel 56 and 56' is formed with a curvilinear free edge 62 and 62' which engages the spherical article contained in the carton. A third tucking and locking panel 64 and 64' is connected to a side edge of the second article framing and retention panel 56 and 56' along a fold line 66 and 66', and is also connected to a triangular connecting panel 68 and 68' along a fold line 70 and 70'. The tucking and locking panel 64 and 64' is formed with a locking projection 65 and 65' on its free edge. The triangular connecting panel 68 and 68' is connected along a fold line 72 and 72' to a second locking panel 74 and 74' which, in turn is connected to the second side wall panel 14 and 14' along a fold line 76 and 76'. The side edge 78 and 78' of the second locking panel 74 and 74' is free of connection with the triangular connecting panel 68 and 68'. Connected to the second locking panel 74 and 74' along a fold line 80 and 80' is a triangular locking panel 82 and 82', which in turn, is connected to a fourth tucking and locking panel 84 and 84' along a fold line 86 and 86'. The tucking and locking panel 84 and 84' is provided with a locking projection 88 and 88' on its free edge. The side edge 90 and 90' of the locking panel 74 and 74' is free of connection with the triangular connecting panel 82 and 82'. A glue flap 92 and 92' is connected to the tucking and locking panel 84 and 84' along a fold line 94 and 94'. It will be noted that each of the locking panels 38 and 38', and 74 and 74' is formed with a pair of lateral-shaped locking tabs 39 and 39', and 75 and 75'.

On the front side of the blank, a locking panel 96 and 96' is connected to the front edge of the second side wall panel 14 and 14' along a fold line 98 and 98'. On the blank 2, there is a triangular connecting panel 98 connected to the locking panel 96 along a fold line 100. The side edge 102 of the locking panel 96 is free of connection with the panel 98, and there is a hook-shaped locking tab 104 formed on the locking panel 96. A tucking and locking panel 106 is connected to the connecting panel 98 along a fold line 108, the panel 106 having a locking projection 110 on its free side. An article framing and retaining panel 112 having a curvilinear free edge 114 for engaging a spherical article disposed in the carton is connected to the tucking and locking panel 106 along a fold line 116 and to the front edge of the top wall panel 10 along a fold line 118. A tucking and locking panel 120 is connected to the panel 112 by a fold line 122, the panel 120 having a locking projection 124 on its free edge and being connected to a triangular connecting panel 126 along a fold line 128. The panel 126 is connected to a locking panel 130 along a fold line 132 with the side edge 134 of the panel 130 being free of connection with the panel 126. A hook-shaped locking tab 136 is formed on the free edge of the locking panel 130. The panel 130 is connected to the front edge of the first side wall panel 6 along a fold line 138.

The blank 2' has an article framing and retaining panel 97' foldably connected to the second side wall panel 10' along a fold line 99'. The panel 97' is divided into three sections, an inner section 101', a medial section 103' and an outer section 105' by fold lines 107' and 109'. A pair of triangular support panels 111' are connected to each side of the medial section 103' by fold lines 113', and a pair of triangular locking flaps 115' are connected to each side of the inner section 101' by fold lines 117'. A locking panel 119' is connected to the front edge of the first side wall panel 6' along a fold line 121'.

Each of the blanks 2 and 2' includes an article framing and retaining panel 140 and 140' connected to the front edge of the bottom wall panel 4 and 4' along a fold line 142 and 142'. The panel 140 and 140' is divided into three sections, an inner section 144 and 144', a medial section 146 and 146', and an outer section 148 and 148' by fold lines 150 and 150', and 152 and 152'. Triangular support panels 154 and 154' are connected to each side edge of the medial section 146 and 146' by fold lines 156 and 156'. A triangular locking panel 158 and 158' is connected to each side of the inner section 144 and 144' by fold lines 160 and 160'.

The steps followed in erecting the carton blank 2 of FIG. 1 will now be set forth. It will be understood that the steps followed to erect the carton blank 2' of FIG. 2 are the same as for the carton blank 2 of FIG. 1 except as will be specifically pointed out hereinafter.

Figure 4:
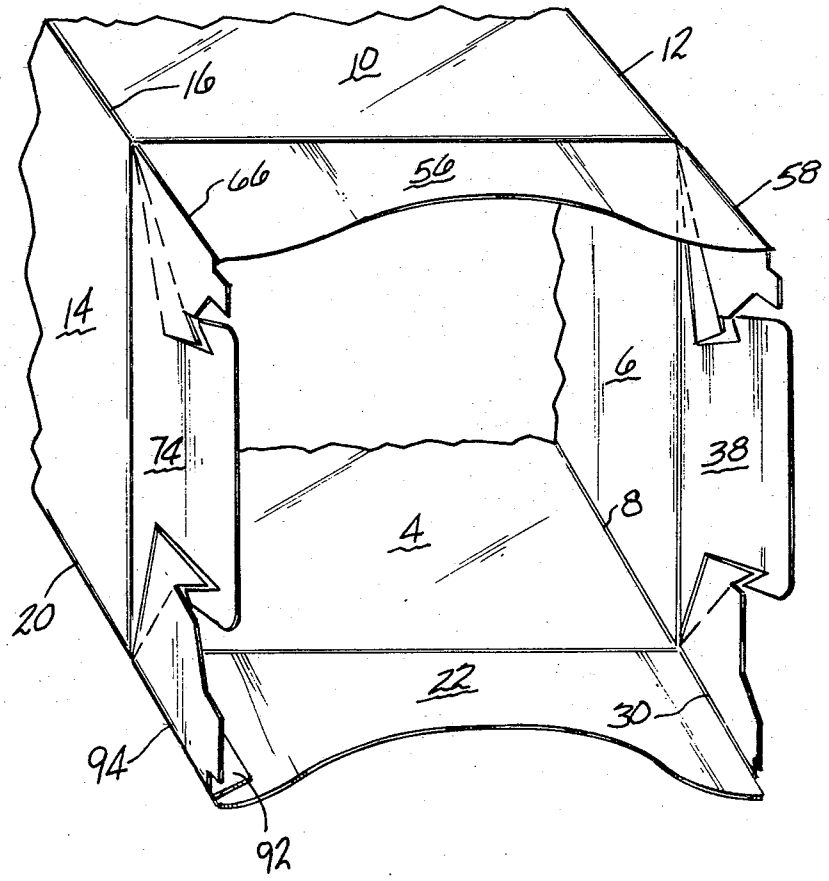
FIG. 4 is a fragmented perspective view of the back end of the partially erected carton of FIG. 3.
Figure 3:
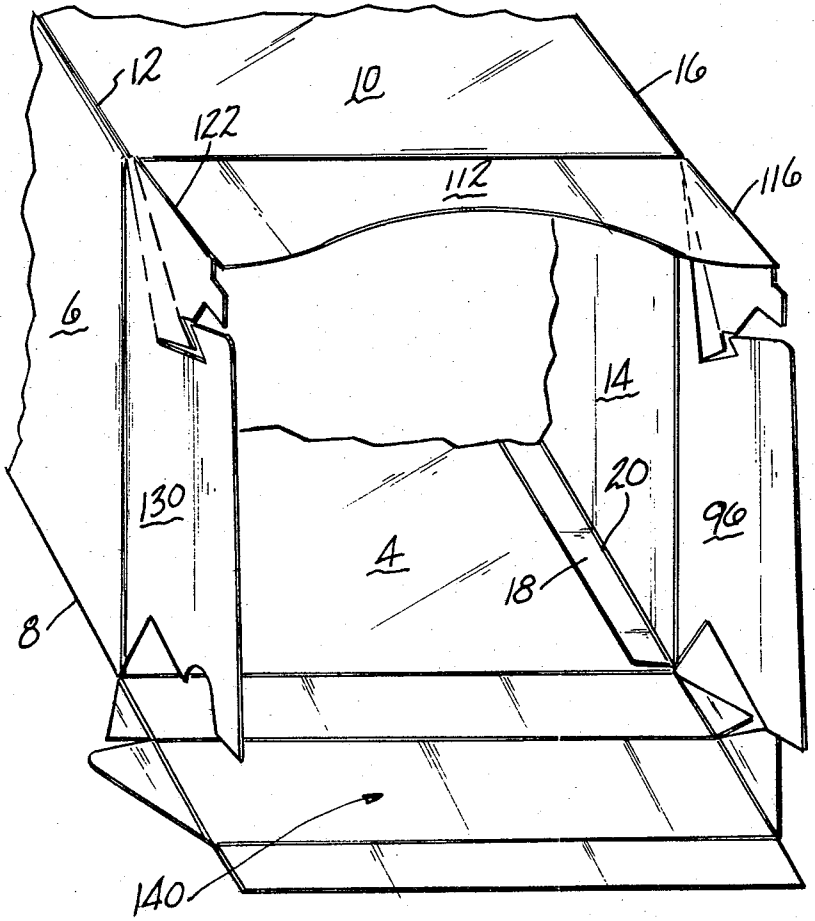
FIG. 3 is a fragmented perspective view of the front end of a partially erected carton using the blank of FIG. 1.

Referring now to FIGS. 3 and 4, there is shown in FIG. 3 a perspective view of the front of a partially erected carton formed from the blank 2 of FIG. 1, and FIG. 4 is a perspective view of the back of such a partially erected carton. The first step in erecting the carton is to fold the blank 2 along the fold lines 8, 12, 16 and 20 with concurrent folding of the fold lines 30, 58, 66, 94, 116 and 122 taking place. The glue flaps 18 and 92 are then glued to the inside surface of the bottom wall panel 4 and the article framing and retaining panel 22 respectively. The result is a tube as shown in FIGS. 3 and 4 with the locking panels 38 and 130 being coplanar with the first side wall panel 6, the locking panels 74 and 96 being coplanar with the second side wall panel 14, the article framing and retaining panels 56 and 112 being coplanar with the top wall panel 10, and the article framing and retaining panels 22 and 140 being coplanar with the bottom wall panel 4.

Figure 5:
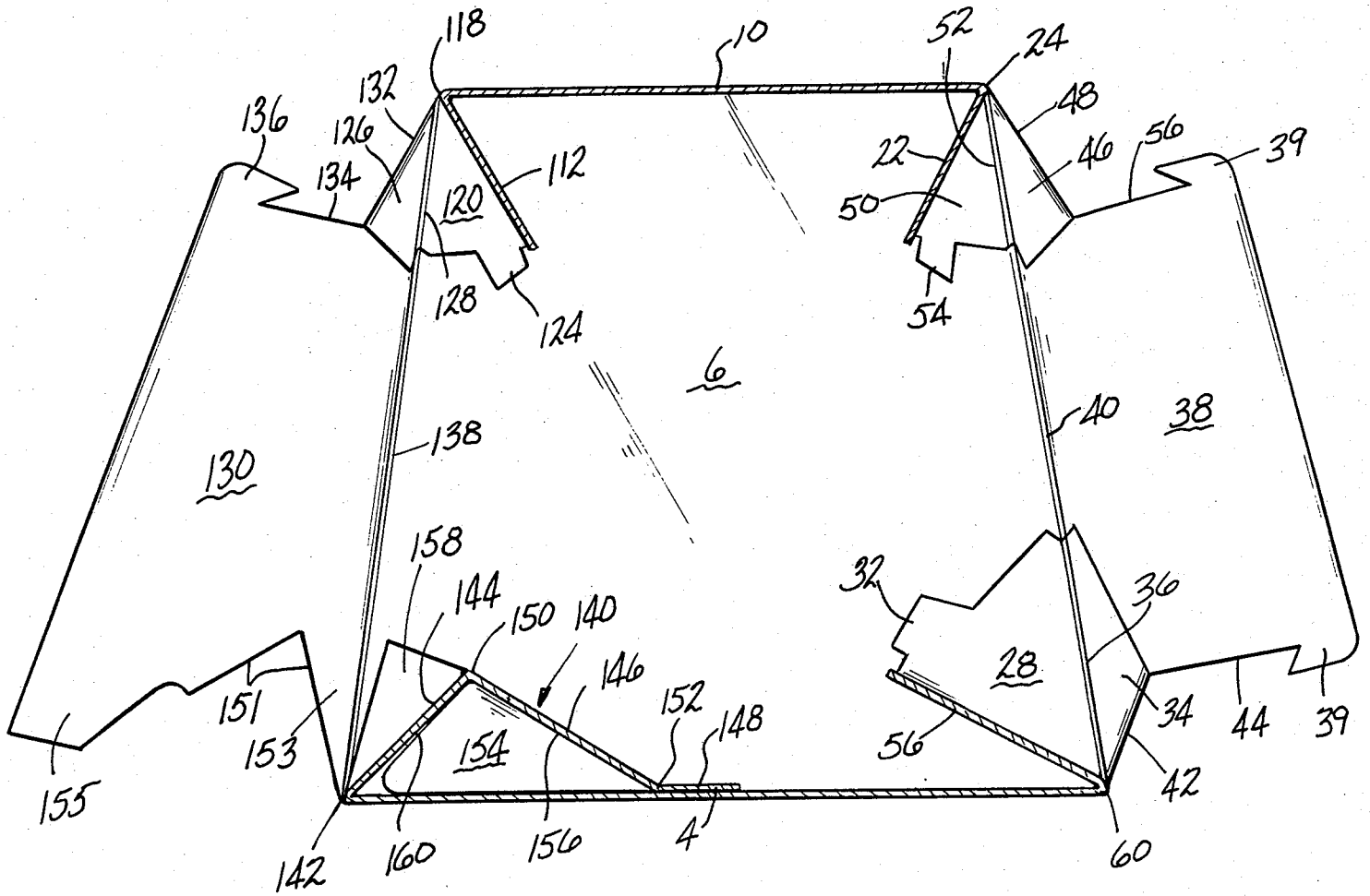
FIG. 5 is a vertical cross sectional view of the partially erected carton of FIGS. 3 and 4 showing subsequent panel folding operable to further the erecting process of the carton.

The next step in erecting the carton is shown in FIG. 5. To reach the partially erected configuration shown in FIG. 5, the article framing and retaining panels 22, 56, 112 and 140 are folded inwardly about the fold lines 24, 60, 118 and 142 respectively. At the same time the triangular connecting panels 34, 46, and 126 are folded inwardly about the fold lines 42, 48 and 132 respectively so as to bring the tucking and locking panels 28, 50 and 120 into face-to-face contact with the first side wall panel 6. The article framing and retaining panel 140 is folded about the fold lines 150 and 152 to bring the outer section 148 into face-to-face contact with the bottom wall panel 4 with the medial section 146 extending upwardly and outwardly, and the inner section 144 extending upwardly and inwardly. The support panel 154 is folded about the fold line 156 to bring the support panel 154 into face-to-face contact with the first side wall panel 6 so as to support the sections 144 and 146 in their angled positions. The locking panel 158 is folded back along the fold line 160 so as to extend toward the fold line 138 and lie in face-to-face contact with the first side wall panel 6. It is, of course understood that similar folding operations are performed on the opposite side of the carton which is not shown in FIG. 5.

Figure 6:
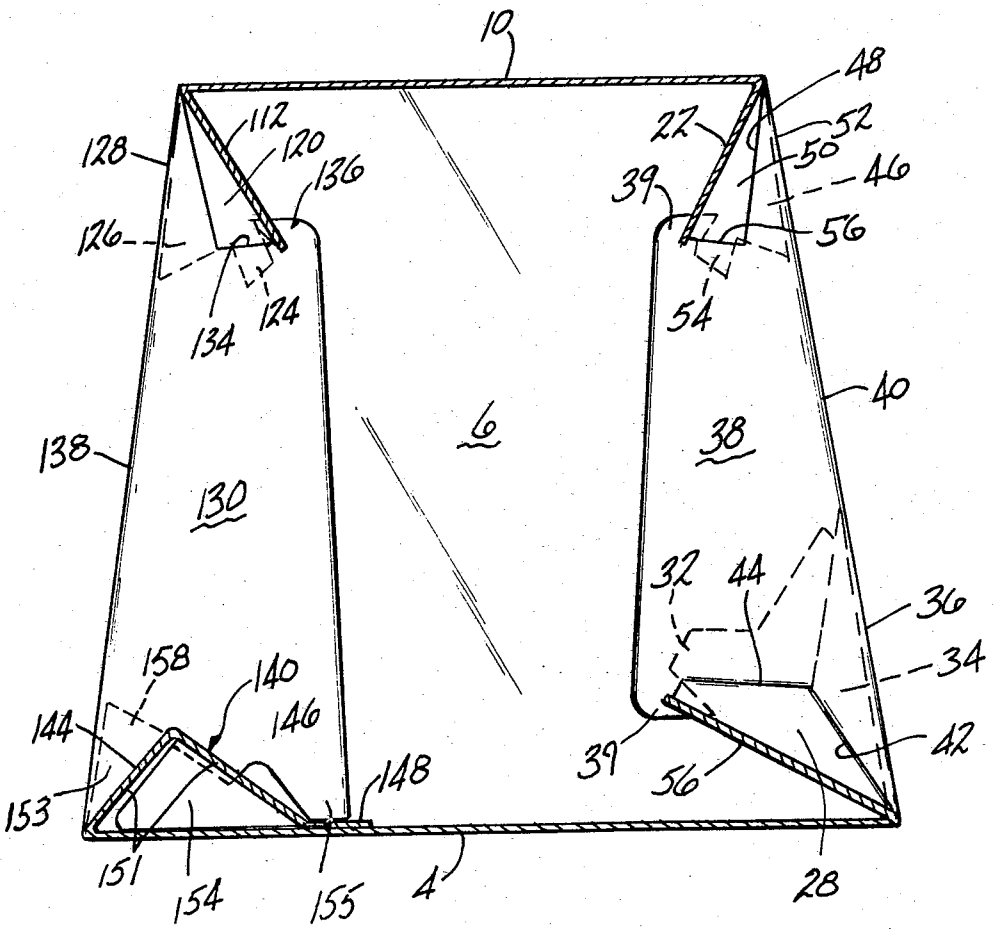
FIG. 6 is a fragmented vertical cross sectional view of the results of the final folding operation used to erect the carton.

The final folding step in erecting the carton is shown in FIG. 6. The locking panel 38 is folded in along the fold line 40 and the triangular connecting panels 34 and 46 are concurrently folded in along the fold lines 36 and 52 respectively. This will bring the panels 34 and 46 into face-to-face contact with the tucking and locking panels 28 and 50 respectively. The hook shaped locking flaps 39 are tucked in between the first side wall panel 6 and the tucking and locking panels 28 and 50 to hold the locking panel 38 in place. The locking projections 32 and 54 project past the free side edges 44 and 56 respectively of the locking panel 38 so as to prevent the tucking and locking panels 28 and 50 from being moved outwardly away from the first side wall panel 6. Thus the locking flaps 39 and the locking projections 32 and 54 form a double locking mechanism which prevents the panels 22 and 56, and the panel 38 from being pulled outwardly of the confines of the carton. A similar locking of the article framing and retaining panel 112 in its operative position is obtained by folding the locking panel 130 about the fold line 138 into the carton. The hook shaped locking flap 136 is tucked in between the panel 120 and the first side wall 6 of the carton and the locking projection 124 extends beyond the free edge 134 of the locking panel 130 and is sandwiched between the latter and the first side wall 6. Thus the same double interlocking mechanism as previously described is formed to hold the panel 112 in place. Referring briefly back to FIG. 5, it will be noted that the lower edge of the locking panel 130 is formed with an inverted V-shaped contour to form an indented edge 151, a lower wing portion 153, and a foot portion 155. When the locking panel 130 is folded to the position shown in FIG. 6, the contoured edge 151 of the panel 130 overlies the sections 144 and 146 of the panel 140, and the foot portion 155 of the panel 130 overlies the section 148 of the panel 140 whereby upward displacement of the panel 140 from its folded position is shown in FIG. 6 is resisted. The wing portion 153 of the panel 130 overlies the locking panel 158 to sandwich the latter between the locking panel 130 and the first side wall 6 whereby outward movement of the panel 140 is resisted by the fold line 138. It will be understood that the folding sequence to position the panel 97' of the blank 2', shown in FIG. 2, is similar to that just described for the panel 140.

Figure 7:
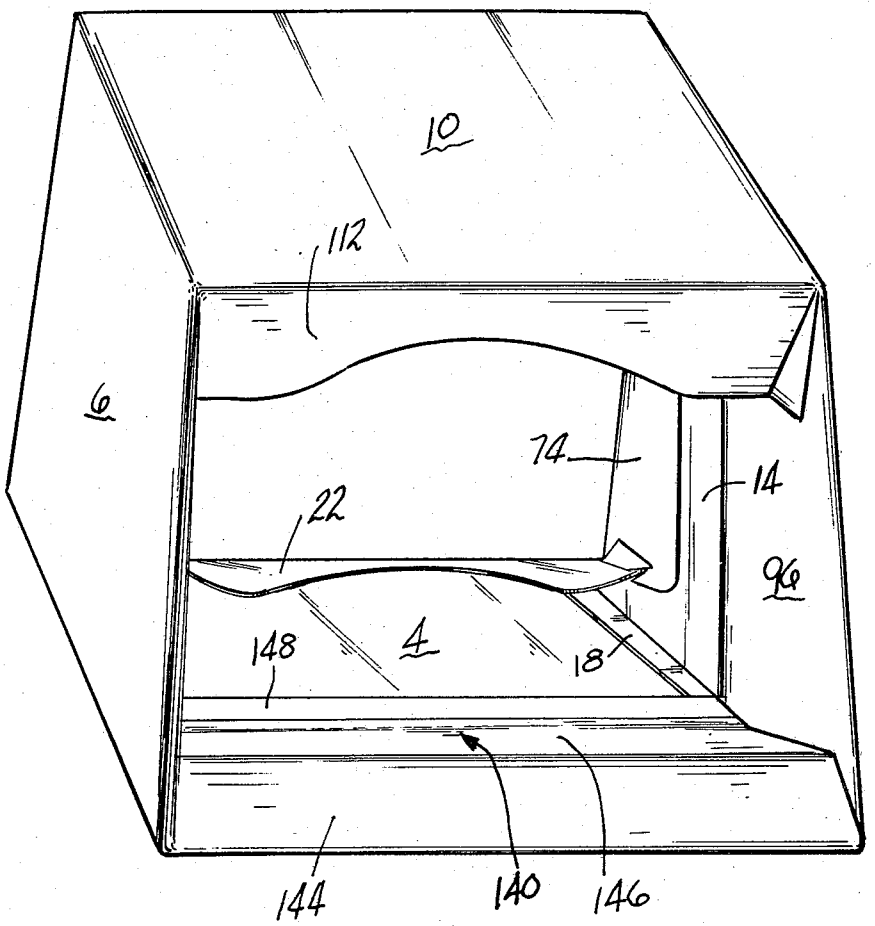
FIG. 7 is a perspective view of the erected carton formed from the blank of FIG. 1.
Figure 8:
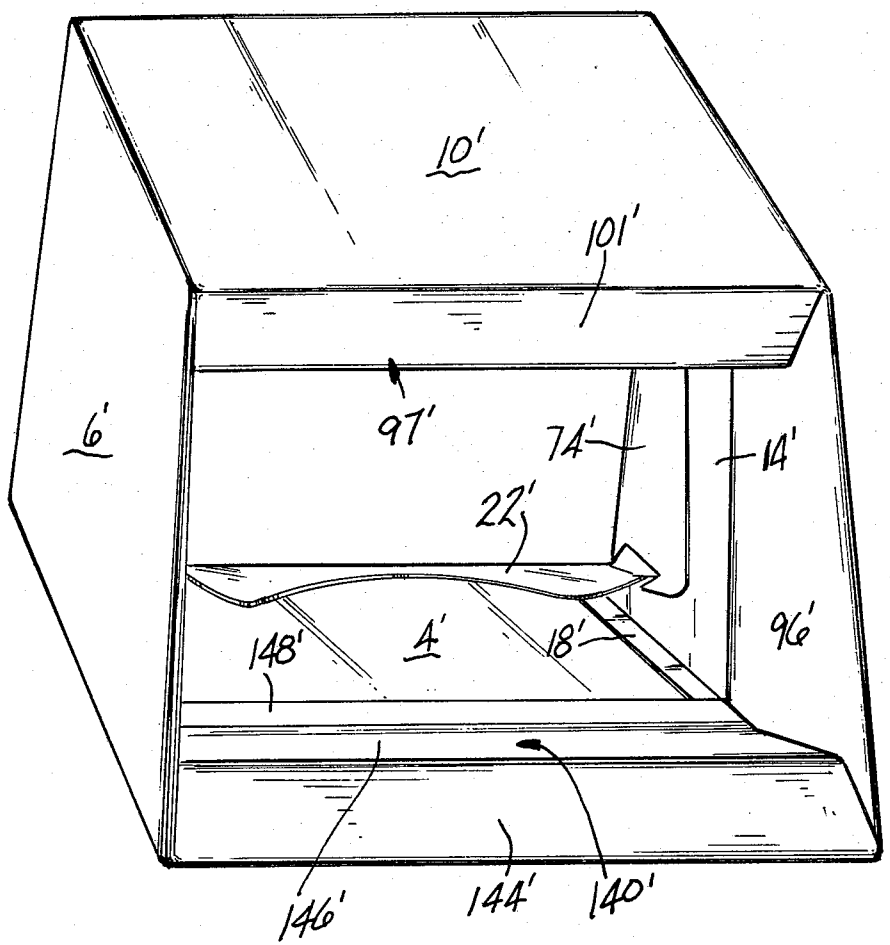
FIG. 8 is a perspective view of the erected carton formed from the blank of FIG. 2.

The fully erected cartons formed from the blanks 2 and 2' are shown in FIGS. 7 and 8 respectively. It will be noted that the article framing and retaining panel 22 and 22' extend upwardly and inwardly into the respective cartons and it will be appreciated that the article framing and retaining panels 56 and 56' extend downwardly and inwardly into the respective cartons. Similarly, the article framing and retaining panels 112 and 101' extend downwardly and inwardly into the respective cartons. The panel sections 144 and 144' extend upwardly and inwardly into the respective cartons, and the panel sections 146 and 146' extend downwardly and inwardly into the respective cartons. The sections 148 and 148' lie flat along the bottom walls 4 and 4' of the respective cartons. After the carton has been erected to the forms shown in either FIGS. 7 or 8, the spherical article to be packaged is inserted into the carton from the back of the carton. When the spherical article, such as a basketball, or the like, is pushed into the carton through the back, the panels 22 and 56, or their counterparts 22' and 56', deflect away from each other to allow the article to enter the carton. When the article contacts the panels 112 and 140 or 97' and 140', the panels 22 and 56, or 22' or 56' will deflect back to their initial positions due to the natural resiliency of the paperboard from which the cartons are made. When the article is in the carton, the panels 22, 56, 112 and 140 or, alternatively, the panels 22', 56' 97' and 140' frame and engage the article so as to retain it in position inside of the carton. At the same time, the article engages the locking panels 38, 74, 96 and 130, or, alternatively, 38', 74', 96' and 119', and presses these locking panels into contact with the adjacent side wall panels of the carton. Thus the product tends to hold the carton in its erected condition. The framing and retention panels cannot be withdrawn from the carton without tearing, thus the article cannot be removed from the carton without its removal being apparent.

It will be readily appreciated that the carton of this invention provides secure containment of a spherical article, such as a basketball, soccer ball, or the like, while at the same time displaying a substantial amount of the article for purchaser perusal. The article is held securely in the carton by means of article framing and retaining panels which cannot be readily dislodged from their operative positions without tearing the carton. Thus more expensive articles cannot be removed from their cartons and placed in a carton holding a less expensive similar article for the purpose of obtaining a lower price for the more expensive article.

Since many changes and variations of the disclosed embodiments of the invention may be made without departing from the inventive concept, it is not intended to limit the invention otherwise than as required by the appended claims.

What is claimed is:

1. A display carton for holding and displaying a spherical article, said carton being formed from a one piece paperboard blank, said carton comprising:

(a) top, bottom and side wall panels connected together along parallel fold lines to form an open ended tubular container;

(b) a plurality of locking panels foldably connected to front and back edges of said side wall panels and folded into the confines of said tubular container adjacent to the inside surfaces of said side wall panels;

(c) a plurality of article framing and retaining panels foldably connected to front and back edges of said top and bottom wall panels and extending into the confines of said tubular container;

(d) at least one of said article framing and retaining panels including a first section extending into said tubular container at an acute angle to the top or bottom wall panel to which it is foldably connected, and a second section foldably connected to said first section and extending inwardly and toward the top or bottom wall panel to which said first section is foldably connected, a pair of locking flaps foldably connected to side edges of said first section and sandwiched between opposed ones of said locking panels and the respective side wall panels to which said ones of said locking panels are foldably connected to prevent withdrawal of said first section from the confines of said tubular container; and (e) a pair of support panels foldably connected to opposite side edges of said second section and disposed adjacent to said side wall panels, said support panels having free edges operable to engage the top or bottom wall panel to which said first section is foldably connected to support said first and second sections and prevent displacement thereof toward the top or bottom wall panel to which said first section is foldably connected.

2. The carton of claim 1, wherein said opposed ones of said locking panels have contoured edges overlying edge portions of said first and second sections to prevent the latter from being displaced away from the top or bottom panel to which said first section is foldably connected.

3. A display carton for holding and displaying a spherical article, said carton being formed from a one piece paperboard blank, said carton comprising:

(a) top, bottom and side wall panels connected together along parallel fold lines to form an open ended tubular container;

(b) a plurality of locking panels foldably connected to front and back edges of said side wall panels and folded into the confines of said tubular container adjacent to the inside surfaces of said side wall panels;

(c) a plurality of article framing and retaining panels foldably connected to front and back edges of said top and bottom wall panels and extending obliquely into the confines of said tubular container;

(d) tucking and locking panels foldably connected to side edges of at least one of said article framing and retaining panels, said tucking and locking panels lying adjacent to the inside surfaces of said side wall panels, and said tucking and locking panels including locking projections extending from edges of said tucking and locking panels past free side edges of said locking panels and sandwiched between said locking panels and said side wall panels; and (e) said locking panels having locking flaps extending from edges thereof and sandwiched between said tucking and locking panels and said side wall panels to combine with said locking projections to form a compound locking mechanism to retain said locking panels and said article framing and retaining panels in position within said tubular container.

4. The carton of claim 3, further comprising connecting panels foldably connected to said tucking and locking panels along one edge and foldably connected to said locking panels along another edge.

5. A display carton for holding and displaying a spherical article, said carton being formed from a one piece paperboard blank, and said carton comprising:

(a) top, bottom and side wall panels connected together along parallel fold lines to form an open ended tubular container;

(b) a plurality of locking panels foldably connected to front and back edges of said side wall panels and folded into the confines of said tubular container adjacent to the inside surfaces of said side wall panels;

(c) a first pair of article framing and retaining panels foldably connected to back edges of said top and bottom wall panels respectively and extending obliquely into the confines of said tubular container, said first pair of article framing and retaining panels having curvilinear free inner edges for engaging the surface of a spherical article disposed in the carton;

(d) tucking and locking panels foldably connected to side edges of each of said article framing and retaining panels, said tucking and locking panels lying adjacent to the inside surfaces of said side wall panels, and said tucking and locking panels including locking projections extending from edges of said tucking and locking panels past free side edges of said locking panels and sandwiched between said locking panels and said side wall panels;

(e) said locking panels having locking flaps extending from edges thereof and sandwiched between said tucking and locking panels and said side wall panels to combine with said locking projections to form a compound locking mechanism to allow said first pair of article framing and retaining panels limited deflection toward said top and bottom wall panels to enable a spherical article to be inserted into the carton through the back side thereof while at the same time restricting deflective movement of said first pair of article framing and retaining panels toward the back end of the carton to prevent removal of a spherical article disposed in the carton through the back end of the carton;

(f) a second pair of article framing and retaining panels foldably connected to front edges of said top and bottom wall panels and extending into the confines of said tubular container, at least one of said second pair of article framing and retaining panels including a first section extending into said tubular container at an acute angle to the top or bottom wall panel to which it is foldably connected, and a second section foldably connected to said first section and extending inwardly and toward the top or bottom wall panel to which said first section is foldably connected;

(g) a pair of locking flap members foldably connected to side edges of said first section and sandwiched between opposed ones of said locking panels and the respective side wall panels to which said ones of said locking panels are foldably connected to prevent withdrawal of said first section from the confines of said tubular container; and (h) a pair of support panels foldably connected to opposite side edges of said second section and disposed adjacent to said side wall panels, said support panels having free edges operable to engage the top or bottom wall panel to which said first section is foldably connected to support said first and second sections and prevent displacement thereof toward the top or bottom wall panel to which said first section is foldably connected.

6. The carton of claim 5, wherein said opposed ones of said locking panels have contoured edges overlying edge portions of said first and second sections to prevent the latter from being displaced away from the top or bottom wall panel to which said first section is foldably connected.

* * * * *